US012606402B2

(12) United States Patent
Nakagawa et al.

(10) Patent No.: US 12,606,402 B2
(45) Date of Patent: Apr. 21, 2026

(54) SHEET TRANSPORT DEVICE THAT TRANSPORTS SHEET TO READING POSITION

(71) Applicant: KYOCERA Document Solutions Inc., Osaka (JP)

(72) Inventors: Takafumi Nakagawa, Osaka (JP); Yoshitaka Tokoro, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 84 days.

(21) Appl. No.: 18/653,026

(22) Filed: May 2, 2024

(65) Prior Publication Data

US 2024/0375904 A1 Nov. 14, 2024

(30) Foreign Application Priority Data

May 10, 2023 (JP) ..... 2023-077907

(51) Int. Cl.
*B65H 29/50* (2006.01)

(52) U.S. Cl.
CPC ..... *B65H 29/50* (2013.01); *B65H 2402/44* (2013.01)

(58) Field of Classification Search
CPC ..... B65H 29/50; B65H 2402/44
See application file for complete search history.

(56) References Cited

U.S. PATENT DOCUMENTS 11,312,588 B2 * 4/2022 Heineck ..... B65H 1/04

FOREIGN PATENT DOCUMENTS

JP 2019131339 A 8/2019
JP 2019131351 A * 8/2019 ..... B65H 1/14

OTHER PUBLICATIONS

Translation of JP-2019131351-A (Year: 2025).*

* cited by examiner

*Primary Examiner* — Howard J Sanders
(74) *Attorney, Agent, or Firm* — IP Business Solutions, LLC.

(57) ABSTRACT

A sheet transport device includes a sheet feeding tray, a reading device, a sheet feeding path, a discharge tray, a discharge path, a discharge elevation device, and a movable wall. On the sheet feeding tray, a plurality of sheets are placed. The discharge tray is located on a lower side of the sheet feeding tray, and receive the plurality of sheets. The discharge path delivers the sheet to the discharge tray. The discharge elevation device moves the discharge path up and down. The discharge path includes a discharge outlet that moves up and down, in a range between the sheet feeding tray and the discharge tray, following an up and downward movement of the discharge path. The movable wall is provided between the discharge outlet and the sheet feeding tray, and changes a posture according to the up and downward movement of the discharge path and the discharge outlet.

6 Claims, 5 Drawing Sheets

SHEET TRANSPORT DEVICE THAT TRANSPORTS SHEET TO READING POSITION

INCORPORATION BY REFERENCE

This application claims priority to Japanese Patent Application No. 2023-077907 filed on May 10, 2023, the entire contents of which are incorporated by reference herein.

BACKGROUND

The present disclosure relates to a sheet transport device.

Image reading apparatuses having a supply tray and a discharge tray are widely known. In such an image reading apparatus, the discharge tray is located on the lower side of the supply tray, and a sheet is transported from the supply tray toward the discharge tray. The transported sheet is delivered to the discharge tray, through a discharge outlet of a discharge unit. When the amount of the sheets placed on the supply tray is decreased, a part of the supply tray is moved upward. In addition, when the amount of the sheets placed on the supply tray is decreased, the discharge unit is moved further upward.

SUMMARY

The disclosure proposes further improvement of the foregoing techniques.

In an aspect, the disclosure provides a sheet transport device including a sheet feeding tray, a reading device, a sheet feeding path, a discharge tray, a discharge path, a discharge elevation device, and a movable wall. On the sheet feeding tray, a plurality of sheets are placed. The reading device reads, at a reading position where the sheet passes, an image on the sheet located at the reading position. The sheet feeding path feeds the sheets placed on the sheet feeding tray one by one, to the reading position of the reading device. The discharge tray is located on a lower side of the sheet feeding tray, and receives the plurality of the sheets. The discharge path delivers the sheet that has passed the reading position, to the discharge tray. The discharge elevation device moves the discharge path up and down. The discharge path includes a discharge outlet that moves up and down following an up and downward movement of the discharge path. The discharge outlet moves up and down in a range between the sheet feeding tray and the discharge tray. The movable wall is provided between the discharge outlet and the sheet feeding tray, and changes a posture according to the up and downward movement of the discharge path and the discharge outlet.

DETAILED DESCRIPTION

Figure 1:
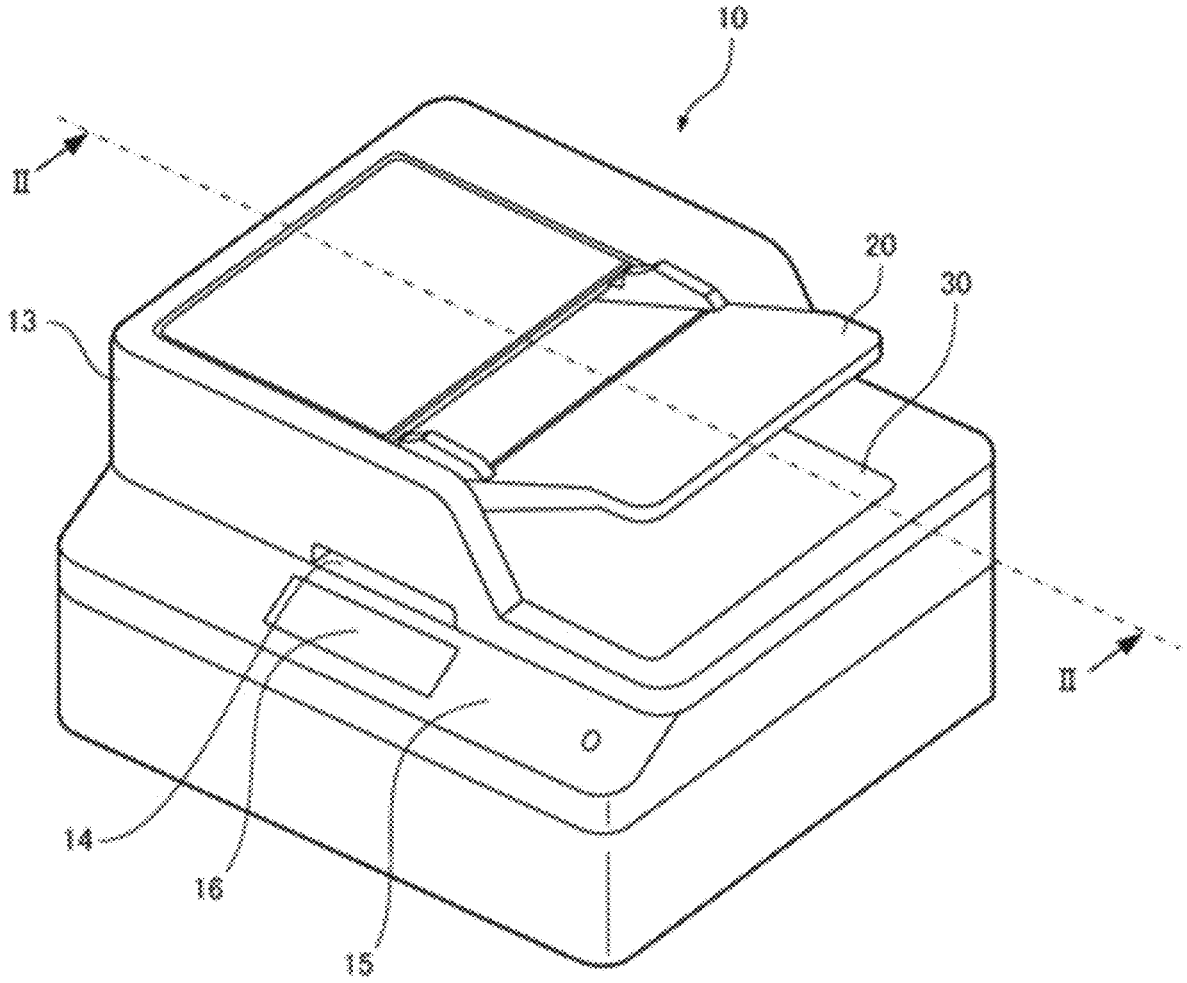
FIG. 1 is a perspective view showing a sheet transport device.

Hereafter, a sheet transport device according to an embodiment of the disclosure will be described, with reference to the drawings. The embodiment will be described hereunder, with reference to the drawings. In the drawings, the same or corresponding elements are given the same numeral, and the description of such elements will not be repeated.

Referring first to FIG. 1, the outline of the sheet transport device 10 will be described. FIG. 1 is a perspective view showing the sheet transport device 10. The sheet transport device 10 is, for example, a multifunction peripheral having a plurality of functions, such as a scanning function for reading an image formed on a paper sheet, and a printing function for forming an image on an image forming medium such as the paper sheet.

The sheet transport device 10 includes a cover unit 13, a sheet table 14, an operation device 15, a display device 16, a sheet feeding tray 20, and a discharge tray 30. On the sheet feeding tray 20, a plurality of sheets can be placed. The discharge tray 30 can receive a plurality of sheets, and is located on the lower side of the sheet feeding tray 20.

The cover unit 13 includes the sheet feeding tray 20 and the discharge tray 30. In FIG. 1, the cover unit 13 is set so as to cover the upper face of the sheet table 14. A non-illustrated hinge is attached to the cover unit 13, so that the cover unit 13 can be set, by being made to pivot about the hinge, to a closed state of covering the upper face of the sheet table 14, and an open state of opening up the upper side of the sheet table 14.

The sheet feeding tray 20 and the discharge tray 30 are inclined downward, toward the inside of the cover unit 13. When the sheet transport device 10 executes the scanning function, the plurality of sheets placed on the sheet feeding tray 20 are delivered one by one, to the inside of the cover unit 13. The image on the sheet is read, inside the cover unit 13. Then the sheets are sequentially delivered to the discharge tray 30, from the inside of the cover unit 13.

The sheet table 14 corresponds to the upper face of a plate formed of an optically transparent material, such as glass. When the cover unit 13 is set to open up the upper side of the sheet table 14, the sheet can be placed on the sheet table 14. When the sheet is placed on the sheet table 14, the reading device 40 can read the image formed on the sheet placed on the sheet table 14.

The operation device 15 is for receiving user's instructions to the sheet transport device 10. The operation device 15 includes, for example, a keyboard and a touch panel. The display device 16 displays various types of information to the user. The display device 16 includes, for example, an LCD. Here, a touch panel display, in which the operation device 15 and the display device 16 are unified, may be provided on the sheet transport device 10.

Figure 2:
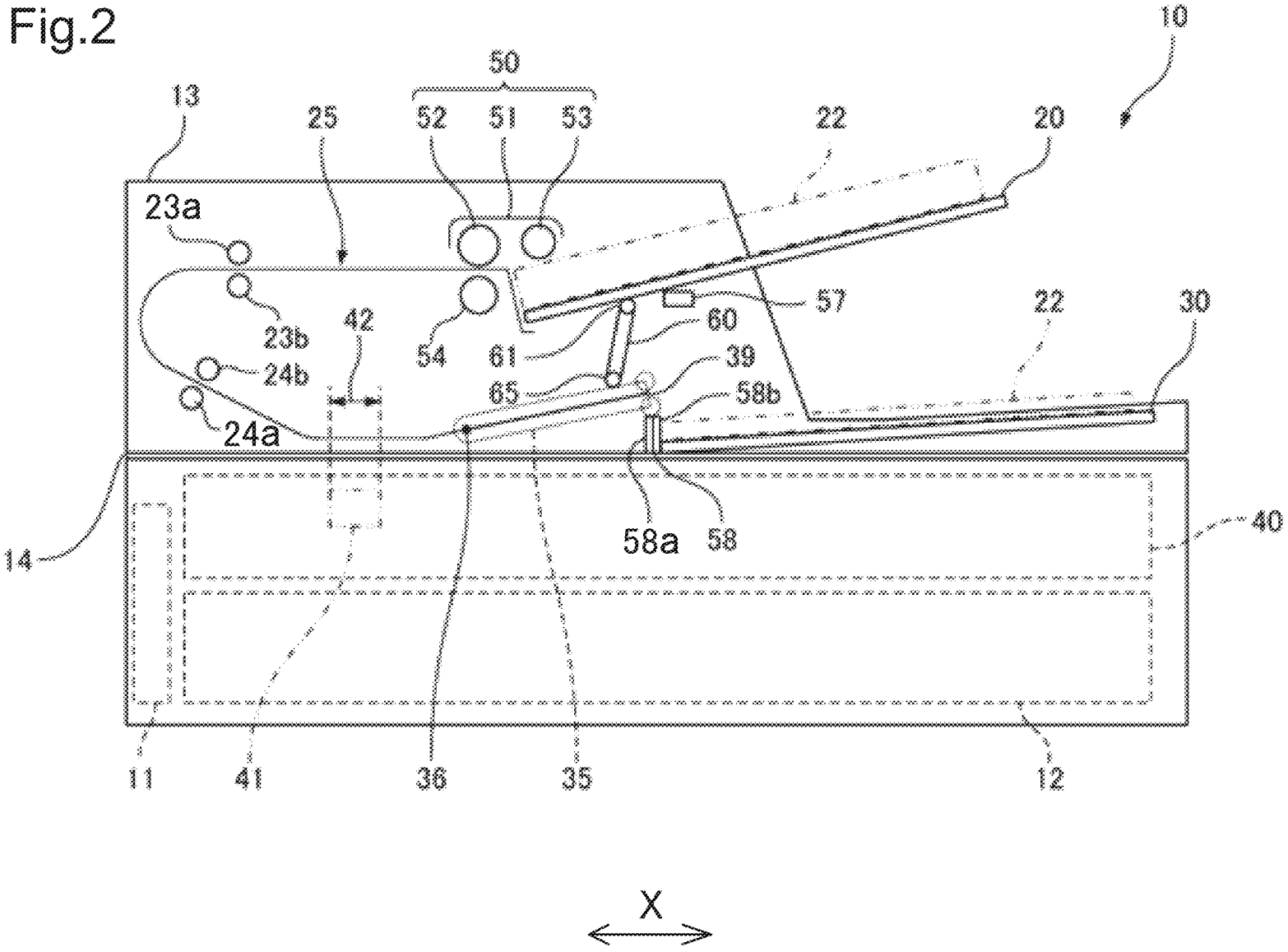
FIG. 2 is a cross-sectional view showing an internal structure of the sheet transport device.
Figure 3:
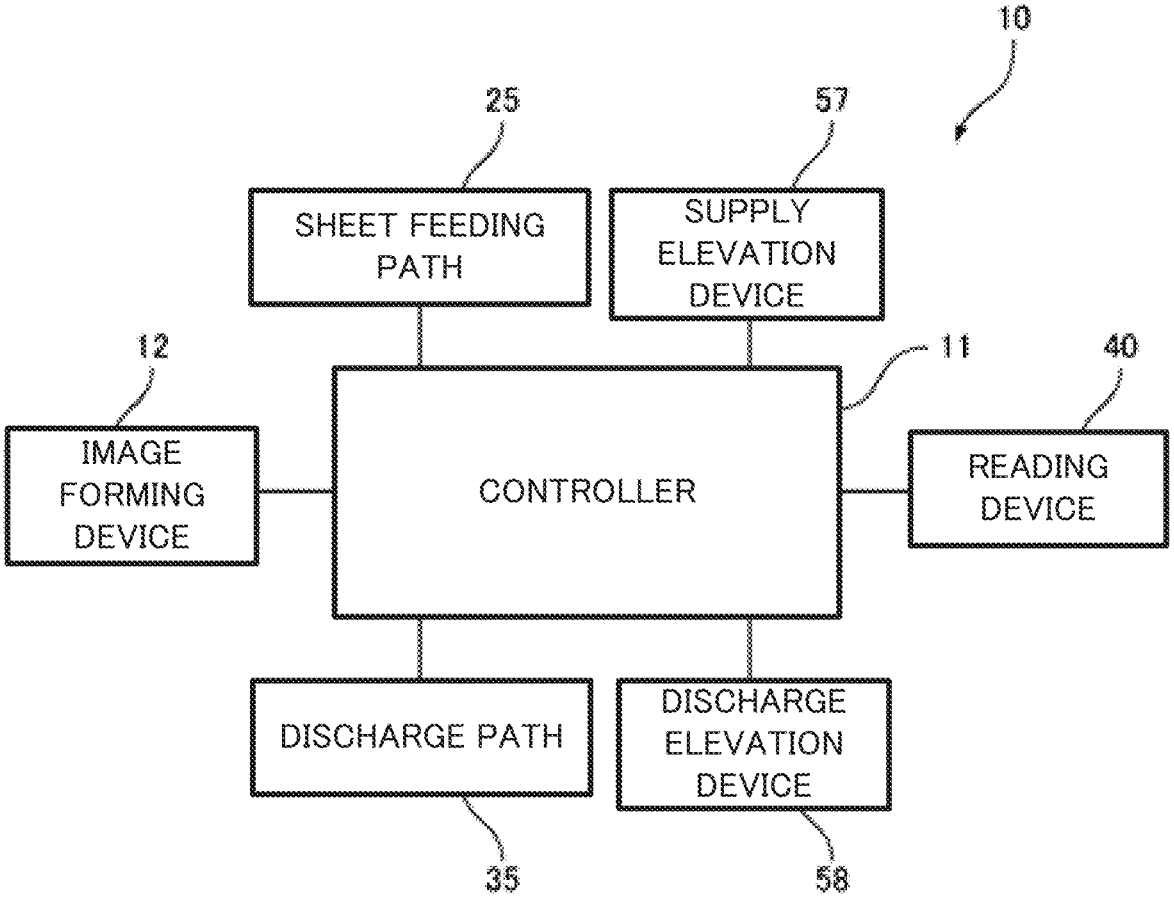
FIG. 3 is a block diagram schematically showing a configuration of the sheet transport device.

Referring to FIG. 2 and FIG. 3, a configuration of the sheet transport device 10 will be described hereunder. FIG. 2 is a cross-sectional view taken along a line II-II in FIG. 1, showing an internal structure of the sheet transport device. FIG. 3 is a block diagram schematically showing the configuration of the sheet transport device 10.

In FIG. 2, a plurality of sheets 22 are placed on each of the sheet feeding tray 20 and the discharge tray 30. The sheet transport device 10 includes a controller 11, an image forming device 12, a sheet feeding path 25, a discharge path 35, a reading device 40, a supply elevation device 57, a discharge elevation device 58, and a movable wall 60, in addition to the sheet feeding tray 20 and the discharge tray 30.

The controller 11 controls the operation of the sheet transport device 10. The controller 11 includes, for example, a central processing unit (CPU) or an application-specific integrated circuit (ASIC). The controller 11 is, for example as shown in FIG. 3, connected to the image forming device 12, the sheet feeding path 25, the discharge path 35, the reading device 40, the supply elevation device 57, and the discharge elevation device 58. The controller 11 is, as shown in FIG. 2, located inside the sheet transport device 10, at a position lower than the sheet table 14.

The image forming device 12 forms an image on an image forming medium, such as a paper sheet, when the sheet transport device 10 executes the printing function. The image forming device 12 may be, for example, an ink jet image forming mechanism, or an electrophotographic image forming mechanism that employs a laser beam. As shown in FIG. 2, the image forming device 12 is located on the lower side of the sheet table 14 and the reading device 40.

The sheet feeding path 25 is for feeding the sheets 22 placed on the sheet feeding tray 20 into inside of the sheet transport device 10, one by one. To be more specific, the sheet transport device 10 feeds the sheets 22 one by one, to a reading position 42 of the reading device 40.

The sheet feeding path 25 includes a pickup device 50, and a plurality of transport rollers, namely a transport roller 23*a*, a transport roller 23*b*, a transport roller 24*a*, and a transport roller 24*b*.

The pickup device 50 includes a holder 51, a separation roller 52, a pickup roller 53, and a retard roller 54. By the pickup device 50, the sheets 22 on the sheet feeding tray 20 are drawn into inside of the sheet transport device 10, one by one. The sheet 22 thus drawn into inside of the sheet transport device 10 is transported along the sheet feeding path 25, by a roller pair composed of the transport roller 23*a* and the transport roller 23*b*, and a roller pair composed of the transport roller 24*a* and the transport roller 24*b*, to be delivered to the reading position 42.

The discharge path 35 is for delivering the sheet 22 that has passed the reading position 42, to the discharge tray 30. The discharge path 35 includes a pivotal shaft 36 and a discharge outlet 39. The discharge path 35 is configured to pivot about the pivotal shaft 36. The pivotal shaft 36 is located at the junction point between the sheet feeding path 25 and the discharge path 35.

The discharge outlet 39 is located at the terminal end of the discharge path 35. The discharge outlet 39 is constituted of a pair of rollers. The roller pair of the discharge outlet 39 rotate in the direction to deliver the sheet 22 passing through the discharge path 35 to the discharge tray 30. The sheet 22 passing through the discharge path 35 is delivered to the discharge tray 30, through between the pair of rollers.

The discharge path 35 is installed such that the discharge outlet 39 is located on the upper side of the discharge tray 30. As the sheets 22 are sequentially delivered through the discharge outlet 39, a plurality of sheets 22 are stacked on the discharge tray 30.

The reading device 40 reads the image formed on the sheet 22 being transported by the sheet transport device 10, when the sheet transport device 10 executes the scanning function. As shown in FIG. 2, the reading device 40 is located under the sheet table 14.

The reading device 40 includes a reading head 41. The reading head 41 reads the image formed on the sheet 22, and converts the optical information representing the image on the sheet 22, to an electrical signal. The reading head 41 includes an image sensor such as a charge-coupled device (CCD), and a light source such as a light-emitting diode (LED).

When the sheet 22 is placed on the sheet table 14, the reading head 41 scans the entirety of the sheet 22, by moving inside the reading device 40 in a direction indicated by X in FIG. 2, so that the reading device 40 reads the whole image on the sheet 22.

When the sheet 22 is not placed on the sheet table 14, but instead supplied from the sheet feeding tray 20, the reading head 41 stays still at a predetermined standby position. A region right above the standby position of the reading head 41 is defined as the reading position 42, for reading the image on the sheet 22. The reading position 42 is the position where the sheet 22 supplied from the sheet feeding tray 20 passes. In other words, the reading head 41 of the reading device 40 reads the image on a portion of the sheet 22 passing the reading position 42. Thus, the sheet 22 moves relative to the reading head 41 staying still at the standby position, so that the reading device 40 reads the whole image on the sheet 22.

The supply elevation device 57 is for moving the sheet feeding tray 20 up and down. The supply elevation device 57 is connected to a non-illustrated drive source such as a motor, and includes a mechanism that converts a driving force supplied by the drive source into a moving force exerted in the up-down direction, thereby moving the sheet feeding tray 20 up and down. The supply elevation device 57 moves the sheet feeding tray 20 up and down, under the control of the controller 11.

The discharge elevation device 58 is for moving the discharge path 35 up and down. The discharge elevation device 58 includes an elevating wall 58*a* and a base wall 58*b*. The elevating wall 58*a* and the base wall 58*b* are located at the proximal end of the discharge tray 30, so as to cover the clearance between the discharge tray 30 and the discharge path 35. The sheet 22 on the discharge tray 30 is abutted against the base wall 58*b*. Therefore, a foreign matter, including the sheet 22, can be prevented from intruding through a space under the discharge outlet 39, to the internal mechanism inside the sheet transport device 10.

The elevating wall 58*a* is configured to slide up and down relative to the base wall 58*b*, by means of an elevation mechanism that converts a driving force, supplied from a non-illustrated drive source such as a motor, into a moving force exerted in the up-down direction. The elevation mechanism moves the elevating wall 58*a* up and down, under the control of the controller 11. The upper end of the elevating wall 58*a* is in contact with the lower face of the discharge path 35, so that when the elevating wall 58*a* moves in the up-down direction, the discharge path 35 is made to move up and down. The discharge outlet 39 located at the terminal end of the discharge path 35 moves up and down, following the up and downward movement of the discharge path 35. The discharge outlet 39 moves up and down in the range between the sheet feeding tray 20 and the discharge tray 30.

The movable wall 60 is provided between the discharge outlet 39 and the sheet feeding tray 20. The movable wall 60 changes the posture, depending on the up and downward movement of the discharge path 35 and the discharge outlet 39. To be more specific, a fulcrum 61 is provided on the upper end of the movable wall 60, as shown in FIG. 2. The fulcrum 61 is connected to the lower face of the sheet feeding tray 20. The movable wall 60 is configured to pivot about the fulcrum 61. In addition, the lower and of the movable wall 60 is configured as a free end 65. The free end 65 is in contact with the upper face of the discharge path 35, but not fixed thereto.

When the discharge path 35 and the discharge outlet 39 move up and down, the free end 65 of the movable wall 60 moves along the upper face of the discharge path 35. In other words, the movement of the free end 65 makes the movable wall 60 pivot about the fulcrum 61, thereby changing the posture of the movable wall 60. Thus, the movable wall 60 changes its posture, according to the up and downward movement of the discharge path 35 and the discharge outlet 39.

The presence of the movable wall 60 between the discharge outlet 39 and the sheet feeding tray 20 prevents a foreign matter, including the sheet 22, from intruding through a space between the discharge outlet 39 and the sheet feeding tray 20, to the internal mechanism inside the sheet transport device 10. In addition, since the movable wall 60 changes its posture according to the up and downward movement of the discharge path 35 and the discharge outlet 39, the presence of the movable wall 60 does not affect the up and downward movement of the discharge path 35 and the discharge outlet 39.

From the viewpoint of suppressing wear, the movable wall 60 may be spaced from the discharge outlet 39 and the sheet feeding tray 20, depending on the posture. Conversely, the movable wall 60 may be set to cover the clearance between the discharge outlet 39 and the sheet feeding tray 20, by changing the posture. When the movable wall 60 covers the clearance between the discharge outlet 39 and the sheet feeding tray 20, the intrusion of a foreign matter into the internal mechanism inside the sheet transport device 10 can be surely prevented.

The transport of the sheet 22 inside the sheet transport device 10 will be described in detail hereunder. First, the plurality of sheets 22 placed on the sheet feeding tray 20 are drawn into inside of the sheet transport device 10 one by one, by the pickup device 50.

The holder 51 of the pickup device 50 is covering the upper side of the separation roller 52 and the pickup roller 53. The holder 51 is configured to pivot about the rotation axis of the separation roller 52. In other words, the pickup device 50 is provided with a pivotal mechanism that allows the holder 51 to pivot about the rotation axis of the separation roller 52. The pivotal movement of the holder 51 makes the pickup roller 53 revolve about the separation roller 52, thereby changing the position of the pickup roller 53. The controller 11 drives the pivotal mechanism so as to bring the pickup roller 53 into contact with the uppermost one of the plurality of sheets 22 placed on the sheet feeding tray 20. With such control, the position of the pickup roller 53 is changed.

The pickup roller 53 provided on the upper side of the sheet feeding tray 20 rotates in contact with the upper face of the uppermost one of the plurality of sheets 22, thereby picking up the uppermost sheet 22, and delivering the sheet 22 to the separation roller 52 and the retard roller 54.

The separation roller 52 and the retard roller 54 are located so as to hold the sheet 22 being transported along the sheet feeding path 25, from the upper side and the lower side, respectively. The separation roller 52 is rotating in the direction to draw the sheet 22 into inside of the sheet transport device 10. On the contrary, the retard roller 54 is rotating in the direction to return the sheet 22 toward the sheet feeding tray 20.

However, the separation roller 52 is given a larger rotative force than that of the retard roller 54 (e.g., frictional force of the circumferential surface of the separation roller 52 with respect to the sheet 22 is larger than that of the circumferential surface of the retard roller 54 with respect to the sheet 22). Accordingly, even though multifeed of the sheets 22 occurs between the separation roller 52 and the retard roller 54, only one of the sheets 22 is extracted, and drawn into inside the sheet transport device 10.

For example, the second sheet 22 from the top may be accidentally made to accompany the uppermost sheet 22, and delivered to the position of the retard roller 54. The second sheet 22 is exempted from being directly subjected to the rotative force of the separation roller 52, because of the presence of the uppermost sheet 22, and is therefore returned by the retard roller 54 toward the sheet feeding tray 20. As result, only the uppermost one, out of the plurality of sheets 22 placed on the sheet feeding tray 20, is drawn into inside of the sheet transport device 10.

The sheets 22 are thus picked up one by one, by the pickup device 50. It is to be noted here, that the pickup device 50 may be configured in a different form from the above, provided that the device is capable of drawing the sheets 22 one by one, into inside of the sheet transport device 10.

The sheet 22 drawn into inside of the sheet transport device 10 is transported along the sheet feeding path 25, by the roller pair composed of the transport roller 23*a* and the transport roller 23*b*, and the roller pair composed of the transport roller 24*a* and the transport roller 24*b*.

Inside the sheet transport device 10, the transport direction of the sheet 22 on the sheet feeding path 25 is turned to a direction opposite to the direction in which the sheet 22 is drawn into inside of the sheet transport device 10. In the example shown in FIG. 2, the transport direction of the sheet 22 is changed from the leftward direction to the rightward direction, inside the sheet transport device 10.

After being turned so as to proceed in the rightward direction, the sheet 22 reaches the reading position 42. When the sheet 22 is located at the reading position 42, the reading device 40 reads the image on the sheet 22. After passing the reading position 42, the sheet 22 is transported along the discharge path 35, and delivered to the discharge tray 30 through the discharge outlet 39.

Figure 4:
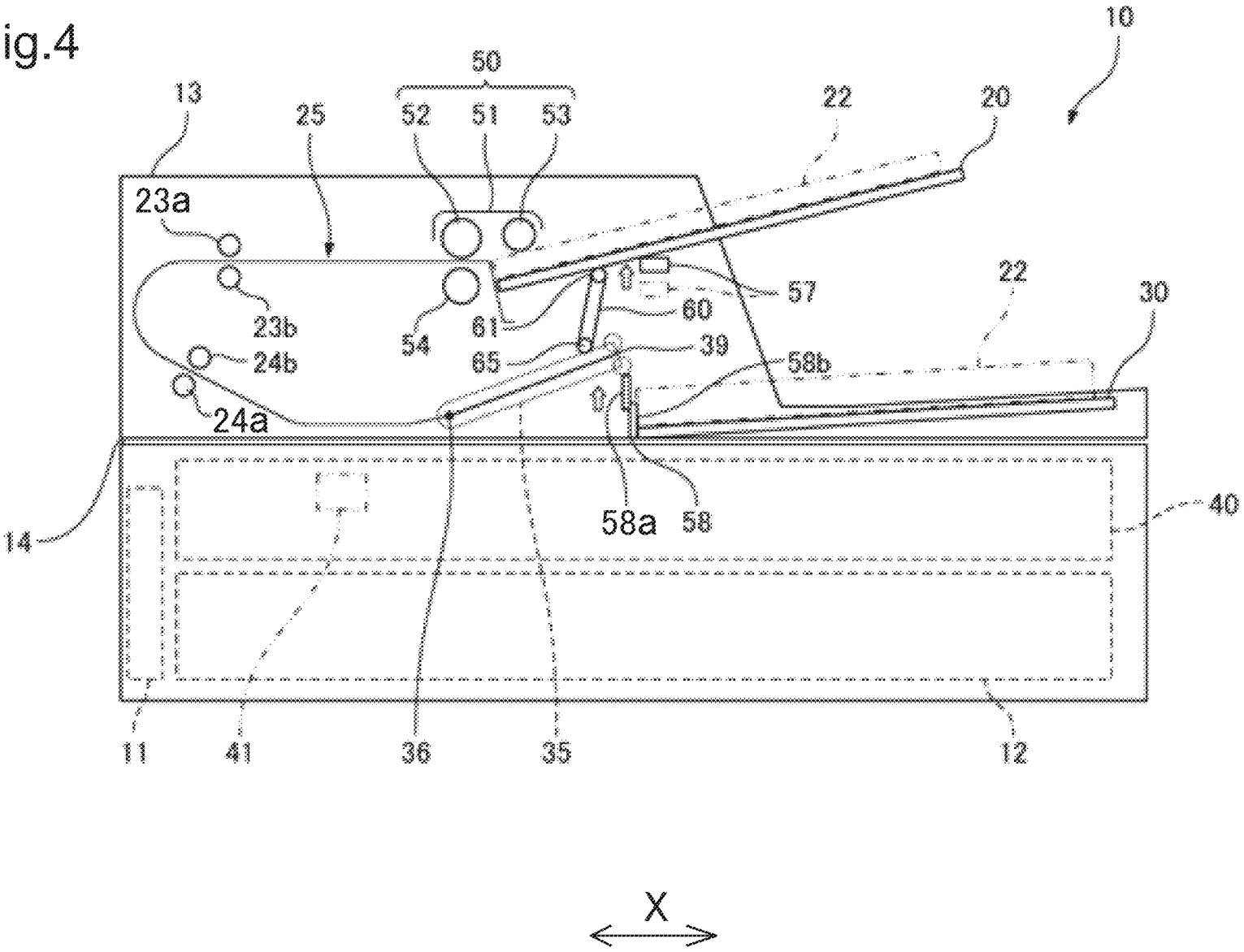
FIG. 4 is a cross-sectional view showing a state where a discharge path and a sheet feeding tray are elevated.

Referring now to FIG. 2 and FIG. 4, the movement of the movable wall 60, following the up and downward movement of the discharge path 35 and the sheet feeding tray 20, will be described hereunder. FIG. 4 is a cross-sectional view showing a state where the discharge path 35 and the sheet feeding tray 20 are elevated.

The controller 11 detects the amount of the sheets 22 placed on the discharge tray 30 and the sheet feeding tray 20, on the basis of, for example, a detection signal outputted from a non-illustrated weight sensor. The weight sensor is located at the position on the discharge tray 30 and the sheet feeding tray 20 to be pressed by the sheets 22, when the sheets 22 are placed thereon. The controller 11 controls the discharge elevation device 58 and the supply elevation device 57, according to the weight (i.e., amount) of the sheets 22 placed on the discharge tray 30 and the sheet feeding tray 20, so as to move the discharge tray 30 and the sheet feeding tray 20 to the position that matches the weight of the sheets 22.

The controller 11 drives the supply elevation device 57 so as to elevate the sheet feeding tray 20 to a higher position, in proportion to a decrease in weight (i.e., amount) of the sheets 22 placed on the sheet feeding tray 20. In other words, the supply elevation device 57 elevates the sheet feeding tray 20 to a higher position, as the sheets 22 placed on the sheet feeding tray 20 are sequentially delivered to the reading position 42.

In FIG. 4, the amount of the sheets 22 placed on the sheet feeding tray 20 is decreased, compared with the state illustrated in FIG. 2. In other words, a certain number of sheets 22 have been delivered to the reading position 42, from the state illustrated in FIG. 2, and therefore the supply elevation device 57 has elevated the sheet feeding tray 20 to the higher position. Thus, the sheet feeding tray 20 is located at the higher position in FIG. 4, compared with the state illustrated in FIG. 2.

When the sheet feeding tray 20 is elevated, the clearance between the sheet feeding tray 20 and the discharge tray 30 becomes wider. Accordingly, with the decrease in amount of the sheets 22 on the sheet feeding tray 20, a larger space above the discharge tray 30 becomes available, and a larger number of sheets 22 can be placed on the discharge tray 30.

The controller 11 drives the discharge elevation device 58 so as elevate the discharge path 35 and the discharge outlet 39 to a higher position, in proportion to an increase in weight (i.e., amount) of the sheets 22 placed on the discharge tray 30. In other words, the discharge elevation device 58 elevates the discharge path 35 and the discharge outlet 39 to a higher position, as the sheets 22 are sequentially delivered to the discharge tray 30.

In FIG. 4, the amount of the sheets 22 placed on the discharge tray 30 is increased, compared with the state illustrated in FIG. 2. In other words, a certain number of sheets 22 have been delivered to the discharge tray 30, from the state illustrated in FIG. 2, and therefore the discharge elevation device 58 has elevated the elevating wall 58*a*, thereby elevating the discharge path 35 and the discharge outlet 39. Thus, the discharge outlet 39 is located at the higher position in FIG. 4, compared with the state illustrated in FIG. 2.

With the increase in amount of the sheets 22 delivered to the discharge tray 30, the top face of the plurality of sheets 22 on the discharge tray 30 is elevated to the higher position. However, since the controller 11 performs the mentioned control operation, the discharge outlet 39 is elevated, so that the clearance between the discharge outlet 39 and the uppermost one of the plurality of sheets 22 is maintained, despite the increase in amount of the sheets 22 on the discharge tray 30. Therefore, although the amount of the sheets 22 on the discharge tray 30 is increased, the sheets 22 on the discharge tray 30 are kept from interfering with the sheet 22 newly discharged through the discharge outlet 39. As result, the sheets 22 can be smoothly discharged.

Further, the elevation of the discharge path 35 and the discharge outlet 39 causes the free end 65 of the movable wall 60 to move along the upper face of the discharge path 35. The movement of the free end 65 causes the movable wall 60 to pivot about the fulcrum 61, thereby changing the posture so as to fit the clearance between the discharge path 35 and the sheet feeding tray 20, with the clearance between the discharge outlet 39 and the sheet feeding tray 20 kept closed. Thus, depending on the up and downward movement of the discharge path 35 and the discharge outlet 39, the movable wall 60 can change its posture about the fulcrum 61 provided thereon.

With the mentioned configuration, since the posture of the movable wall 60 can be changed depending on the up and downward movement of the discharge path 35 and the discharge outlet 39, there is no need to provide a unit for driving the movable wall 60. Therefore, the movable wall 60 can be provided at a low cost. In addition, the movable wall 60 can be easily added to the sheet transport device 10 originally manufactured without the movable wall 60.

Figure 5:
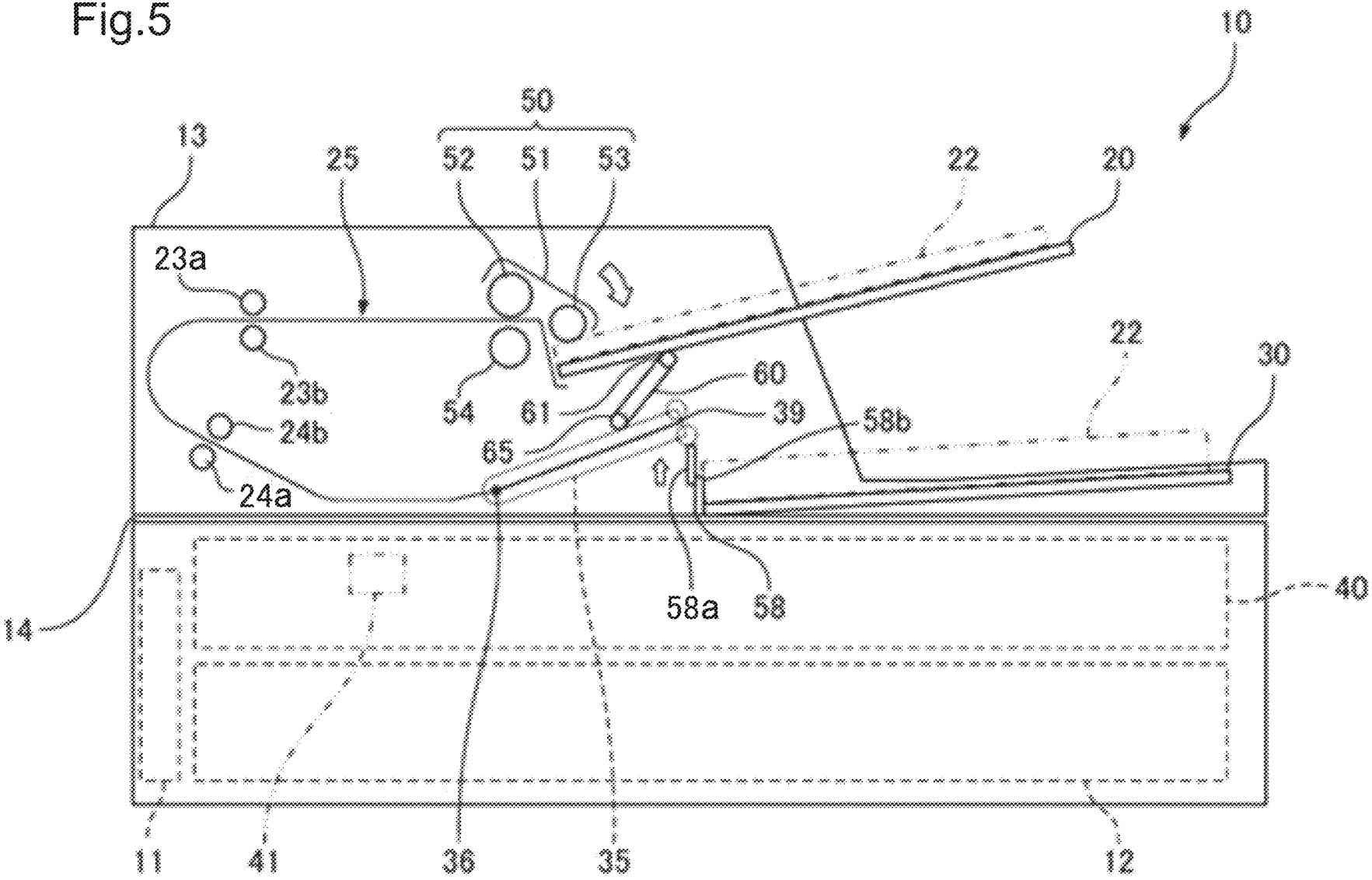
FIG. 5 is a cross-sectional view showing a state where only the discharge path is elevated.

Here, although both of the sheet feeding tray 20 and the discharge path 35 are elevated in FIG. 4, the controller 11 may keep from elevating the sheet feeding tray 20. The case where the sheet feeding tray 20 is not elevated, but only the discharge path 35 (and discharge outlet 39) is elevated will be described hereunder, with reference to FIG. 2 and FIG. 5. FIG. 5 is a cross-sectional view showing a state where only the discharge path 35 is elevated.

Even though the sheet feeding tray 20 is not elevated, the controller 11 causes the pickup roller 53 to revolve, so as to make contact with the uppermost one of the plurality of sheets 22 placed on the sheet feeding tray 20. For example, the controller 11 is storing therein pivotal amounts, by which the holder 51 is to be made to pivot about the rotation axis of the separation roller 52, prespecified according to the weight (amount) of the sheets 22 on the sheet feeding tray 20. Such pivotal amount is specified so as to bring the pickup roller 53 into contact with the uppermost one of the plurality of sheets 22 placed on the sheet feeding tray 20, with respect to each of predetermined increments of the weight of the sheet 22. The controller 11 causes the holder 51 of the pickup device 50 to pivot about the rotation axis of the separation roller 52, by such pivotal amount. In FIG. 5, the holder 51 has been made to pivot clockwise, from the state illustrated in FIG. 2. Such pivotal movement of the holder 51 causes the pickup roller 53 to revolve about the separation roller 52.

Referring to FIG. 5, even though the amount of the sheets 22 on the sheet feeding tray 20 is decreased, the pickup roller 53 moves to the position shown in FIG. 5, thereby making contact with the uppermost one of the plurality of sheets 22. Therefore, the pickup device 50 can deliver the sheets 22 one by one into inside of the sheet transport device 10, even in the state illustrated in FIG. 5.

On the other hand, the discharge elevation device 58 elevates the discharge path 35 and the discharge outlet 39, with the increase in weight (amount) of the sheets 22 on the discharge tray 30. With the elevation of the discharge path 35 and the discharge outlet 39, the movable wall 60 changes its posture about the fulcrum 61.

In the state illustrated in FIG. 5, since the sheet feeding tray 20 is not elevated, but only the discharge path 35 and the discharge outlet 39 are elevated, the clearance between the sheet feeding tray 20 and the discharge path 35 becomes narrower. The movable wall 60 is configured to assume the posture that fits the clearance between the sheet feeding tray 20 and the discharge path 35, and therefore tilts by a larger angle, when the clearance between the sheet feeding tray 20 and the discharge path 35 becomes narrower. In FIG. 5, the movable wall 60 is inclined by a larger angle, compared with the state illustrated in FIG. 4.

Since the movable wall 60 is configured to change its posture about the fulcrum 61 provided thereon, the movable wall 60 can assume the posture that fits the clearance between the sheet feeding tray 20 and the discharge path 35 as shown in FIG. 5, despite the sheet feeding tray 20 remaining immobile.

In an existing image reading apparatus, when a part of the supply tray is moved upward, because of a decrease in amount of the sheets placed on the supply tray, the clearance between the discharge outlet of the discharge unit and the supply tray becomes wider. In such a case, a foreign matter, such as the hand of the user or the sheet, may intrude into the mechanism inside the image reading apparatus, through the clearance between the discharge outlet and the supply tray, when the amount of the sheets placed on the supply tray is decreased.

With the configuration according to the foregoing embodiment, in contrast, the presence of the movable wall 60 between the discharge outlet 39 and the sheet feeding tray 20 prevents a foreign matter such as the sheet 22 from intruding through between the discharge outlet 39 and the sheet feeding tray 20, into inside of the mechanism in the sheet transport device 10.

The embodiment of the disclosure has been described as above, with reference to the drawings. However, the disclosure is not limited to the foregoing embodiment, but may be modified in various manners, without departing from the scope of the disclosure. The drawings each schematically illustrate the elements for the sake of clarity, and the thickness, length, number of pieces, and interval of the illustrated elements may be different from the actual ones, because of the convenience in making up the drawings. Further, the material, shape, and size of the elements referred to in the foregoing embodiment are merely exemplary and not specifically limited, and may be modified as desired, without substantially departing from the configuration according to the disclosure.

INDUSTRIAL APPLICABILITY

The disclosure provides the sheet transport device, and is therefore industrially applicable.

What is claimed is:

1. A sheet transport device comprising:

a sheet feeding tray on which a plurality of sheets are placed;

a reading device that reads, at a reading position where the sheet passes, an image on the sheet located at the reading position;

a sheet feeding path that feeds the sheets placed on the sheet feeding tray one by one, to the reading position of the reading device;

a discharge tray located on a lower side of the sheet feeding tray, and configured to receive the plurality of sheets;

a discharge path that delivers the sheet that has passed the reading position, to the discharge tray;

a discharge elevation device that moves the discharge path up and down; and a movable wall, wherein the discharge path includes a discharge outlet that moves up and down, following an up and downward movement of the discharge path, the discharge outlet moves up and down in a range between the sheet feeding tray and the discharge tray, the movable wall is provided between the discharge outlet and the sheet feeding tray, and changes a posture according to the up and downward movement of the discharge path and the discharge outlet, wherein the movable wall is configured to pivot about a fulcrum which is provided on an upper end of the movable wall and connected to the lower face of the sheet feeding tray, a lower end of the movable wall is a free end which is in contact with an upper face of the discharge path, but not fixed to the discharge path, and when the discharge path and the discharge outlet move up and down, the free end of the movable wall moves along the upper face of the discharge path.

2. The sheet transport device according to claim 1, wherein the movable wall covers a clearance between the discharge outlet and the sheet feeding tray, by changing the posture according to the up and downward movement of the discharge path and the discharge outlet.

3. The sheet transport device according to claim 1, further comprising a supply elevation device that moves the sheet feeding tray up and down, wherein the supply elevation device elevates the sheet feeding tray, as the sheets placed on the sheet feeding tray are sequentially transported to the reading position.

4. The sheet transport device according to claim 1, wherein the discharge elevation device elevates the discharge path and the discharge outlet, as the sheets are sequentially delivered to the discharge tray.

5. The sheet transport device according to claim 4, wherein the discharge elevation device includes an elevating wall, a base wall, and an elevation mechanism, the elevation mechanism causes the elevating wall to move in an up-down direction so as to slide relative to the base wall, and an upper end of the elevating wall is in contact with a lower face of the discharge path, and the discharge path moves up and down, when the elevating wall moves in the up-down direction.

6. The sheet transport device according to claim 5, wherein the elevating wall and the base wall cover a clearance between the discharge tray and the discharge path, when the elevating wall moves the discharge path up and down, by moving in the up-down direction.

* * * * *